United States Patent [19]

Mann

[11] Patent Number: 4,949,011

[45] Date of Patent: Aug. 14, 1990

[54] KLYSTRON WITH REDUCED LENGTH

[75] Inventor: Joseph K. Mann, Grants Pass, Oreg.

[73] Assignee: Varian Associates, Inc., Palo Alto, Calif.

[21] Appl. No.: 330,656

[22] Filed: Mar. 30, 1989

[51] Int. Cl.[5] ..... H01J 25/02; H01J 25/34

[52] U.S. Cl. ..... 315/5; 315/5.39; 315/5.43; 330/44

[58] Field of Search ..... 315/5, 5.39, 5.51, 5.43, 315/5.14, 5.16, 5.42, 5.25, 5.28, 5.45; 330/44, 45; 333/230, 231

[56] References Cited

U.S. PATENT DOCUMENTS

| | | | |
|---|---|---|---|
| 3,195,007 | 7/1965 | Watson et al. | 315/5.43 |
| 3,381,163 | 4/1968 | La Rue et al. | 315/5.39 |
| 4,155,027 | 5/1979 | Schriber et al. | 315/5.42 X |

*Primary Examiner*—Eugene R. LaRoche
*Assistant Examiner*—Seung Ham
*Attorney, Agent, or Firm*—Stanley Z. Cole; Gerald M. Fisher; Peter J. Sgarbossa

[57] ABSTRACT

In a multicavity klystron amplifier, the drift-tube bore is larger (46) in proportion to the beam size (10) in the non-interacting space between gaps (28) than its size (22) at the gaps (28). This decreases the spacecharge wavelength so that the overall physical length of the klystron is shortened.

1 Claim, 1 Drawing Sheet

KLYSTRON WITH REDUCED LENGTH

FIELD OF THE INVENTION

The invention pertains to klystron amplifier tubes, particularly klystrons with large frequency bandwidth employing many interaction cavities and critical intercavity spacings.

PRIOR ART

In klystron power-amplifiers the overall length of the tube has been set by the desired gain, which increases with the number of beam-interaction cavities and also to some extent with the lengths between cavities. The bandwidth has been determined by the number of cavities, by their respective resonant frequencies, by their intrinsic bandwidth (Q's) and by the lengths between cavities. In determining bandwidth, and in some respects efficiency, the important lengths are in terms of space-charge-wavelengths in the beam. This is also known as the plasma wavelength, because the cloud of electrons is a plasma of charged particles, in this case all negatively charged without a neutralizing cloud of interspersed positive heavy ions as in a gaseous plasma discharge. The space-charge wavelength is the distance the electrons travel during a complete repetitive cycle of longitudinal compression by velocity modulation, and the ensuing expansion by the mutual repulsion of the space-charge force between electrons. The repulsive space-charge force between electrons increases with the instantaneous current-density in the beam, and hence the space-charge-wavelength decreases. The diameter of the drift-tube has been chosen for proper coupling of the beam to the rf electric field across the cavity gaps. It is necessary to have the drift tube small enough and the gaps short enough so the electrons traverse the gap fields before the instantaneous rf field changes more than a fraction of a cycle.

In the prior art, the total length of the klystron was thus determined by the required voltage and current of the beam, the operating frequency and the gain and bandwidth required.

SUMMARY OF THE INVENTION

The object of the invention is to provide a klystron amplifier of reduced overall length.

This object is achieved by drift tubes between gaps of diameters larger than the diameter of the beam apertures at the gaps.

DESCRIPTION OF A PREFERRED EMBODIMENT

Figure 1:
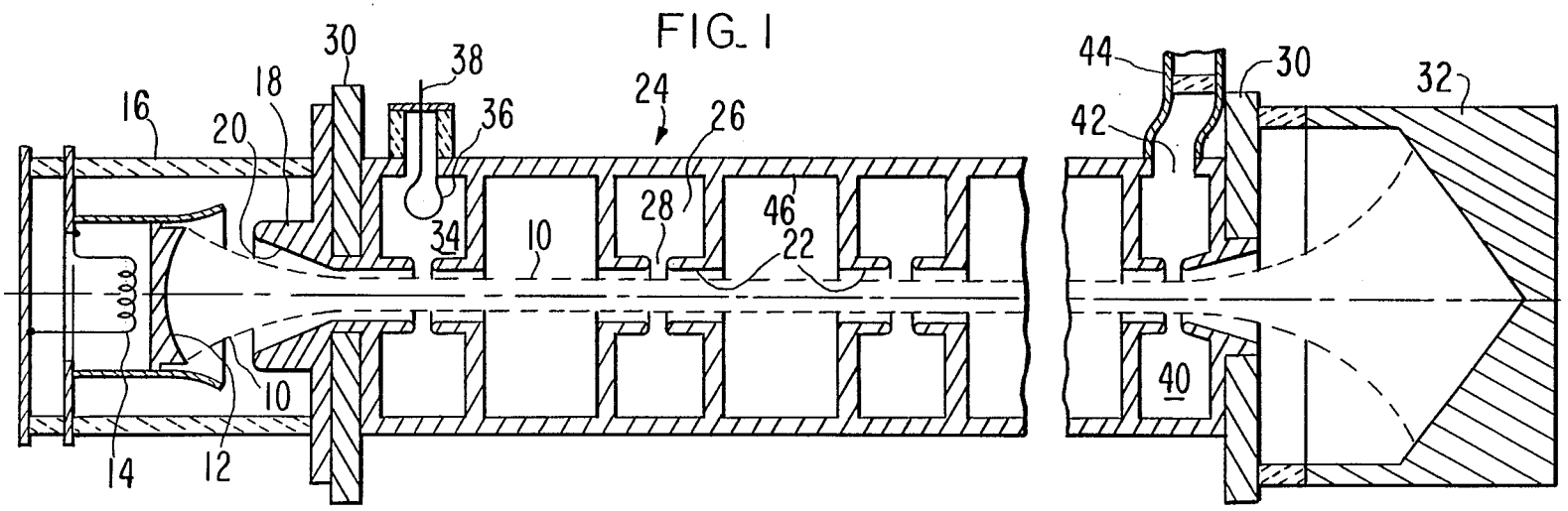
FIG. 1 is a foreshortened schematic axial section of a klystron embodying the invention.

In FIG. 1 an electron beam 10 is drawn from the concave surface of a thermionic cathode 12 which is heated by a radiant wire coil 14 and supported on a dielectric cylindrical section 16 of the vacuum envelope. Beam 10 converges due to electrostatic force from an anode 18 with a central aperture 20 through which beam 10 passes via the inner bore 22 of a drift tube through the klystron's beam-interaction circuit 24 comprising a plurality of sequential resonant cavities 26 having as center conductors sections of drift tube 22 with interaction gaps 28 across which the rf cavity fields are applied to beam 10. Inside interaction circuit 24, beam 10 is kept focused into an essentially uniform diameter by an axial magnetic field generated between annular iron polepieces 30 by an external solenoid or permanent magnet (not shown). Beyond output polepiece 30, the magnetic field falls off quickly, allowing beam 10 to expand under its repulsive space-charge force to be collected on the inner surface of a large, hollow collector electrode 32. An input rf signal is supplied to the first cavity 34 from a coupling loop 36 fed by a coaxial transmission line 38. Amplified rf power is extracted from the final cavity 40 through an iris 42 into an output waveguide 44.

The novel feature of the invention is that the metal shell, or envelope, surrounding beam 10 is enlarged between cavities 26 from the bore 22 at interaction gaps 28 into larger diameter sections 46. I have found that this variation in spacing between beam 10 and its surrounding metallic envelope 22–46 allows the length of the klystron to be materially reduced, with savings in space requirement, weight of tube and magnet, and cost.

Figure 2:
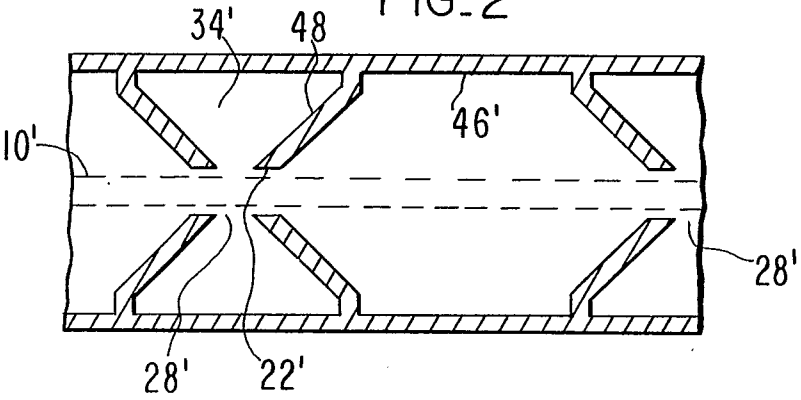
FIG. 2 is a partial section of a modified embodiment.

FIG. 2 is a sketch of an axial cross-section of a portion of a slightly different embodiment. Resonant interaction cavity 34' has drift-tube projections 48 which are conically tapered down to the drift-tube bore 22' which clears beam 10' by a small margin. Just beyond successive gaps 28' the drift-tube bore enlarges conically to 46' to provide reduced space-charge wavelength in this non-interacting region. The smaller sized bore 22' needs to extend axially from gaps 28' only for a distance comparable to its diameter to provide adequate cooling cross-section and beam-coupling fields. The effective length of the large-bore section is thus increased over that of FIG. 1 because part of the enlarged part is inside cavities 26.

The origin of the inventive shortening may be described in terms of the space-charge wavelength mentioned above.

The repulsive force between an electron and another spaced along the beam from it is reduced by the presence of a metal drift-tube surrounding the beam. Some of the lines of force from each electron are diverted to the surrounding shield, reducing the force on the distant electron even more than the inverse square law applying in free space. The reduced force makes the space-charge wavelength increase with the closeness of the drift tube to the beam. As described above, the diameter of the tube at the gaps must be as small as possible for good coupling between circuit and beam. According to the present invention, the drift tube between the gaps is made considerably larger than at the gaps. This reduces the shielding factor, increases the repulsive force and decreases the space-charge wavelength. As described above, the proper length of the klystron is determined by the required number of space-charge wavelengths to achieve the desired performance, so the physical length of the tube is decreased by the invention.

The above explanation is based on the usually correct assumption that the beam diameter is held approximately constant throughout the entire interaction region. In a tube with magnetic or electrostatic lenses between gaps to periodically refocus the beam, it will have maximum diameter at the lenses and be focused to a minimum diameter between the lenses. Since a certain minimum diameter is needed at the gaps, as explained above, the lenses should be placed midway between gaps (where the diameter is maximum). To maintain clearance between beam and drift tube, it may sometimes be necessary to enlarge the drift tube between gaps. This might be interpreted as anticipating the invention, but in fact it is not and the effect would be exactly opposite to the purpose of the present invention. The basic space-charge wavelength increases with decreased electron density in the beam because the repulsive forces are lower and the oscillatory period hence longer. Thus, if the drift-tube diameter is increased just to accommodate the periodic bulges in beam diameter, the net average space-charge wavelength goes up instead of down as in the invention. To achieve the goal of the invention it is necessary to have the drift-tube diameter increase with respect to the beam diameter, as specified in the claims.

The above embodiments are exemplary and not to be limiting. Other embodiments within the scope of the invention will appear to those skilled in the art. Beside the two geometries described in the described embodiments, other shapes of enlargements may produce the desired result. Also, the resonant cavities need not be cylindrical as described, but shaped as rectangular, e.g. to accommodate adjustable tuning means. The invention is to be limited only by the following claims and their legal equivalents.

I claim:

1. A multi-cavity klystron amplifier tube with a conductive hollow drift tube with a passage for an electron beam of essentially uniform diameter in energy-exchanging relation with an interaction circuit comprising:

a series of resonant cavities surrounding said beam passage;

gaps in said drift tube within said cavities for coupling high-frequency electric cavity fields to said beam;

the diameter of said passage over a part of its length between two successive gaps being greater than said diameter at said gaps.

* * * * *